US010434362B1

(12) United States Patent
Stevenson

(10) Patent No.: US 10,434,362 B1
(45) Date of Patent: Oct. 8, 2019

(54) EXERCISE ASSEMBLY

(71) Applicant: VitaGlide, LLC, Miami, FL (US)

(72) Inventor: Hugh Stevenson, Miami, FL (US)

(73) Assignee: VitaGlide, LLC, Miami, FL (US)

( * ) Notice: Subject to any disclaimer, the term of this patent is extended or adjusted under 35 U.S.C. 154(b) by 189 days.

(21) Appl. No.: 15/431,423

(22) Filed: Feb. 13, 2017

Related U.S. Application Data

(60) Provisional application No. 62/443,896, filed on Jan. 9, 2017.

(51) Int. Cl.

| | |
|---|---|
| ***A63B 21/00*** | (2006.01) |
| ***A63B 23/12*** | (2006.01) |
| ***A63B 24/00*** | (2006.01) |
| ***A63B 71/06*** | (2006.01) |

(52) U.S. Cl.
CPC ..... *A63B 21/4045* (2015.10); *A63B 21/4035* (2015.10); *A63B 23/12* (2013.01); *A63B 24/0003* (2013.01); *A63B 24/0062* (2013.01); *A63B 24/0087* (2013.01); *A63B 71/0619* (2013.01); *A63B 2220/805* (2013.01)

(58) Field of Classification Search
CPC ..... A63B 21/4045; A63B 71/0619; A63B 24/0003; A63B 24/0062; A63B 23/12; A63B 21/4035; A63B 24/0087; A63B 2220/805
See application file for complete search history.

(56) References Cited

U.S. PATENT DOCUMENTS 5,203,751 A * 4/1993 Chang ..... A63B 22/0002 482/51
7,497,815 B1 3/2009 Caden et al.

* cited by examiner

*Primary Examiner* — Sundhara M Ganesan
(74) *Attorney, Agent, or Firm* — Malloy & Malloy, P.L.

(57) ABSTRACT

An exercise assembly for execution of an exercise regimen by a user having a base assembly and a support assembly. The exercise assembly includes a resistive track assembly mounted to a portion of the support assembly. The resistive track assembly has a plurality of resistive track members each having a resistive track channel through a portion thereof. The exercise assembly further includes a carriage assembly having at least one handle interconnected to at least one carriage through the resistive track channel of a corresponding resistive track member. Each handle and carriage is moveable along a portion of a corresponding resistive track member. The resistive force assembly includes a plurality of resistive force members, and at least one resistive force member is interconnected to each carriage to present a resistive force to counter movement of the carriage along a corresponding resistive track member.

10 Claims, 12 Drawing Sheets

EXERCISE ASSEMBLY

BACKGROUND OF THE INVENTION

Field of the Invention

The present invention is directed to an exercise assembly having a carriage assembly movably interconnected to a resistive track assembly, and a resistive force assembly operatively engaging at least one carriage of the carriage assembly to counter movement of the carriage either forward or backward along a portion of a corresponding track member of the restive track assembly.

Description of the Related Art

In modern day society routine exercise has become increasingly popular as a means to lose weight, maintain muscles and provide for better overall health. Numerous exercise devices are currently available to an individual, depending upon the goals one wishes to attain. In addition to common, cardiovascular exercises such as running, jogging, walking, the exercise industry has developed numerous machines and exercise equipment. Such known devices are designed and structured to exercise the entire body by the performance of various prescribed exercise procedures. In addition, specialized exercise devices are available which are structured to concentrate on certain parts of a person's body.

Before the existence of present technological advancements, perhaps the most common exercise equipment comprised "free weights". As such, a plurality of different barbells and like free weight structures were used in combination with specific exercises in an effort to develop the arms, legs, shoulders and various other parts of the human body. However, for years free weights and a majority of the exercise equipment which was made commercially available was designed for individuals having the full use of their entire body. Except recently, relatively few exercise machines or like equipment was available for use by individuals with some type of physical handicap. More specifically, individuals suffering from spinal cord injuries and having lost the use of the legs or lower part of the body are typically restricted to travel by means of a wheel chair or like manual or motorized propulsion device. Further, such individuals were significantly restricted from using conventional, full body or specialized exercise equipment which was originally intended for use by individuals not having a physical handicap.

Because of the recognized need of the handicapped for exercise and/or therapy, there currently exists numerous exercise machines, specialized devices and like equipment which are specifically intended for use by physically challenged individuals. Such individuals commonly have the free use of the arms, hands, shoulders, and upper torso above the waist. However, it has recently been determined that a significant amount of the currently and commercially available exercise devices intended for the handicapped provide a type of exercise which is less than totally beneficial. By way of example, the majority of the restricted exercise equipment are designed to provide "arm cranking" or other arm exercise procedures in order to develop and maintain and rehabilitate the muscles of the upper part of the body. Unfortunately, participation in these activities have been associated with increased incidences of upper extremity injuries and pain. Moreover, medical professionals have suggested that the movement pattern and muscle utilization involved in these arm cranking or continuous rotational movements involve an excessive shoulder pressing action in an internally rotated position. The result is the production of an unbalanced stress and a repetitive use syndrome.

To the contrary, several pieces of conventional and existing exercise equipment not capable of being used by invalids or other physically restricted individuals offer a lower body cycling motion concurrently with a reciprocal press/pull arm action. Such devices include various exercise bicycles and elliptical runner systems. The action provided with such systems is further characterized by linear hand movement. These systems provide a much greater shoulder range of motion than the rotational arm cranking procedure as described above. In addition shoulder extension resulting from pulling the arm past the mid-line of the body is also extremely beneficial. The muscles involved in such pulling actions include the latissimus dorsi, rhomboids, rear deltoid and rotator cuff muscles. Obviously, persons with significant torso disabilities are not able to use such system. As a result, the aforementioned muscle groupings are typically under developed and without significant resting tone when the user is restricted to a wheel chair.

Another known exercise assembly for a user's upper body comprises a frame at a spaced apart distance therefrom, wherein the spaced apart distance is adjustable, and includes a base disposed on a supporting surface and a track assembly fixedly connected to the frame. The track assembly includes an open end and a closed end and two track segments collectively convergent from the open end to the closed end, and wherein the two track segments are connected to the frame in fixed relation to one another and angularly inclined relative to the supporting surface. Two hand grips are linearly and reciprocally movable along different ones of the track segments, and a resistance assembly including a line extending along a predetermined path of travel in interconnecting relation to the hand grips, including a resistance mechanism engaging the line, is structured to exert a movement restrictive force thereon. The open end is disposed and sufficiently dimensioned to at least partially receive a user between corresponding proximal ends of the two track segments while the user is in a seated, substantially upright orientation. It is noted that this assembly only permits movement of the hand grips in opposite directions, i.e., when one hand grip is moved away from the user, the other hand grip is moved towards the user.

Accordingly, there is a need in the exercise industry for an exercise assembly specifically, but not exclusively, intended for use by handicapped individuals of the type set forth above. Such an improved exercise assembly should be able to provide linearly directed push/pull motions of the arms, shoulders, etc., rather than the aforementioned arm cranking motion. Moreover, it would be advantageous for an exercise assembly to provide linear and reciprocal action arm movement while in a seated position. It would further be beneficial for such an exercise assembly to permit arm movement in either the same, uniform direction or in reciprocal, opposite directions. A further advantage would be realized for an exercise assembly to allow a user to control an amount of resistive force presented at each hand grip or handle, and further, for the user to control the direction in which the force is presented, as noted above. Such an improved exercise assembly will allow a user to enhance and strengthen the development of a larger array of muscle groups than possible with previously known exercise devices, the muscle groups including not only the latissimus dorsi, rhomboids, rear deltoids and rotator cuff muscles, but also the pectoral muscles and other lateral muscle groupings.

SUMMARY OF THE INVENTION

The present invention is directed to an exercise assembly for execution of an exercise regimen by a user. In one embodiment, the exercise assembly comprises a base assembly having a base comprising at least one base member. A support assembly having a support member is interconnected to the base, and in one embodiment, the resistive track assembly is mounted to a portion of the support assembly. In one further embodiment, a resistive track assembly is positionably mounted to a support member.

A resistive track assembly in accordance with one embodiment of the present invention comprises at least one resistive track member, and in one further embodiment, a resistive track assembly comprises a plurality of resistive track members, wherein each of the resistive track members has a resistive track channel disposed through a portion thereof.

In accordance with one embodiment of the present invention, an exercise assembly includes a carriage assembly comprising at least one handle interconnected to at least one carriage through a resistive track channel of at least one resistive track member. In one further embodiment, a carriage assembly includes at least one handle interconnected to at least one carriage through a different one of each of a plurality of resistive track members, wherein each handle and interconnected carriage are moveable along a portion of a corresponding one of the plurality of resistive track members.

The present exercise assembly includes a resistive force assembly. A resistive force assembly includes at least one resistive force member, and in one embodiment, a resistive force assembly comprises a plurality of resistive force members, at least one of the plurality of resistive force members interconnected to a different one of each carriage to present a preselected resistive force to counter movement of the carriage along the portion of the corresponding one of the plurality of resistive track members.

A resistive force assembly in accordance with one embodiment of the present invention includes at least one resistive force drive, however, in at least one further embodiment, a resistive force assembly comprises a plurality of resistive force drives, wherein each of the plurality of resistive force drives operably engages a different one of each of a plurality of resistive force members and exerts a preselected resistive force thereto to counter movement of a carriage along a portion of a corresponding one of a plurality of resistive track members.

A control module is provided in accordance with at least one embodiment of the present invention and is operable with a resistive force assembly to control a preselected resistive force exerted by one or more resistive force drives on one or more resistive force members.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 6 is a front elevation of a portion of one illustrative embodiment of an exercise assembly in accordance with the present invention.

Like reference numerals refer to like parts throughout the several views of the drawings.

DETAILED DESCRIPTION OF THE PREFERRED EMBODIMENT

Figure 1:
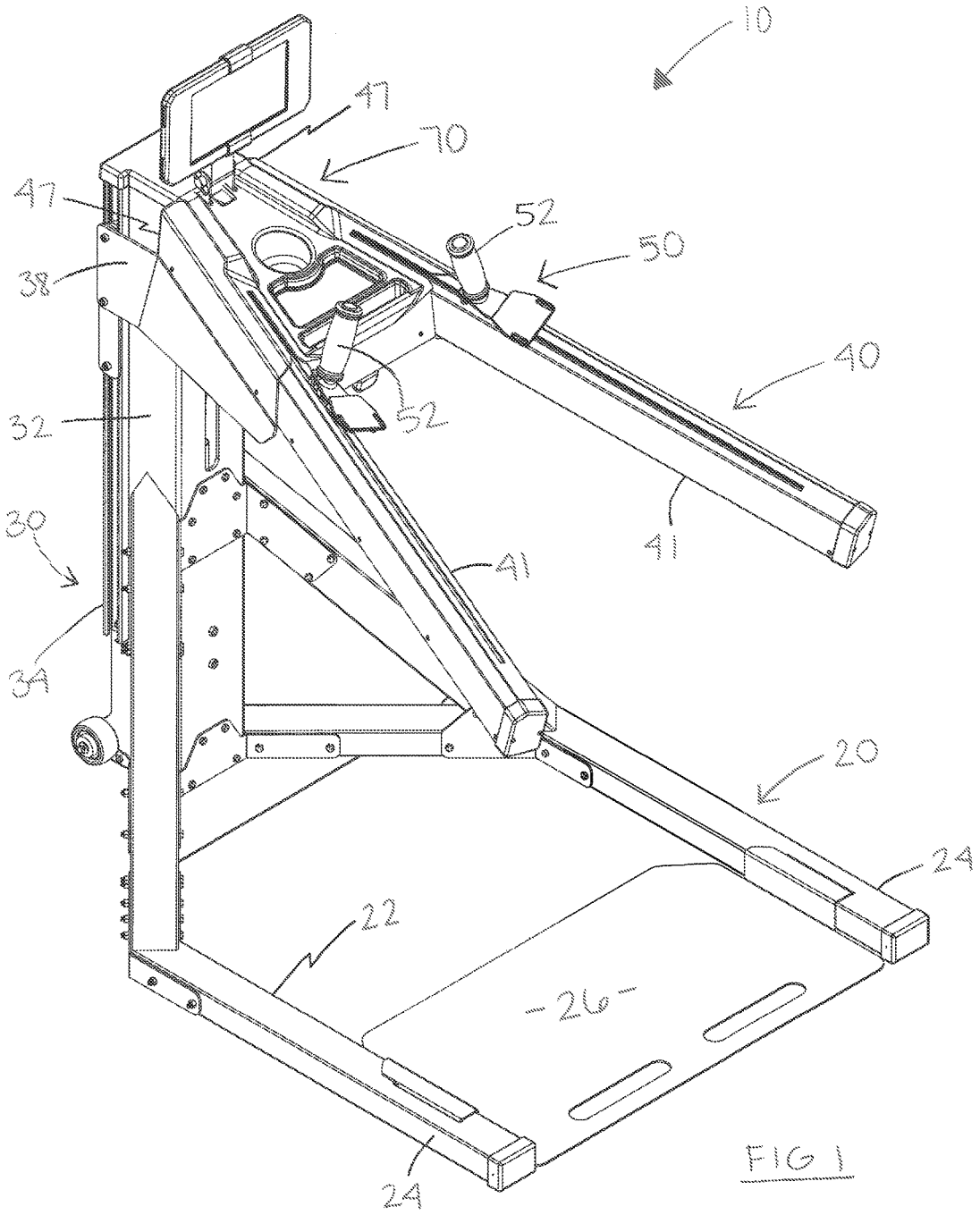
FIG. 1 is a perspective view of one illustrative embodiment of an exercise assembly in accordance with the present invention having a carriage assembly disposed in a retracted orientation.

The present invention is directed to an exercise assembly, generally as shown as 10 throughout the figures, for execution of an exercise regime by one or more users. More in particular, the present exercise assembly 10 is structured and disposed to facilitate execution of an exercise regime by a user which allows for linearly directed push/pull motions of the user's arms, shoulders, etc. As will become more apparent from the following description, the present exercise assembly 10 further facilitates allowing a user to control an amount and direction of resistive force against which one or both of the user's arms, shoulders, etc., act against. As such, the present exercise assembly allows a user to enhance and strengthen the development of a larger array of muscle groups than possible with previously known exercise devices, the muscle groups including not only the latissimus dorsi, rhomboids, rear deltoids and rotator cuff muscles, but also the pectoral muscles, brachioradialis, flexor carpi ulnaris, and other lateral muscle groupings, such as, trapezius muscles.

In at least one embodiment, an exercise assembly 10 in accordance with the present invention includes a base assembly 20 which forms a base 22 to permit staging of the exercise assembly 10 on a supporting surface. A base 22 comprises at least one base member 24, wherein the base member 24 is disposable on a supported surface. In at least one further embodiment, such as is shown in the illustrative embodiment of FIG. 1, a base assembly 20 comprises a plurality of base members 24 cooperatively structured and interconnected to form base 22 which, once again, serves to support the exercise assembly 10 on a supporting surface (not shown).

Figure 2:
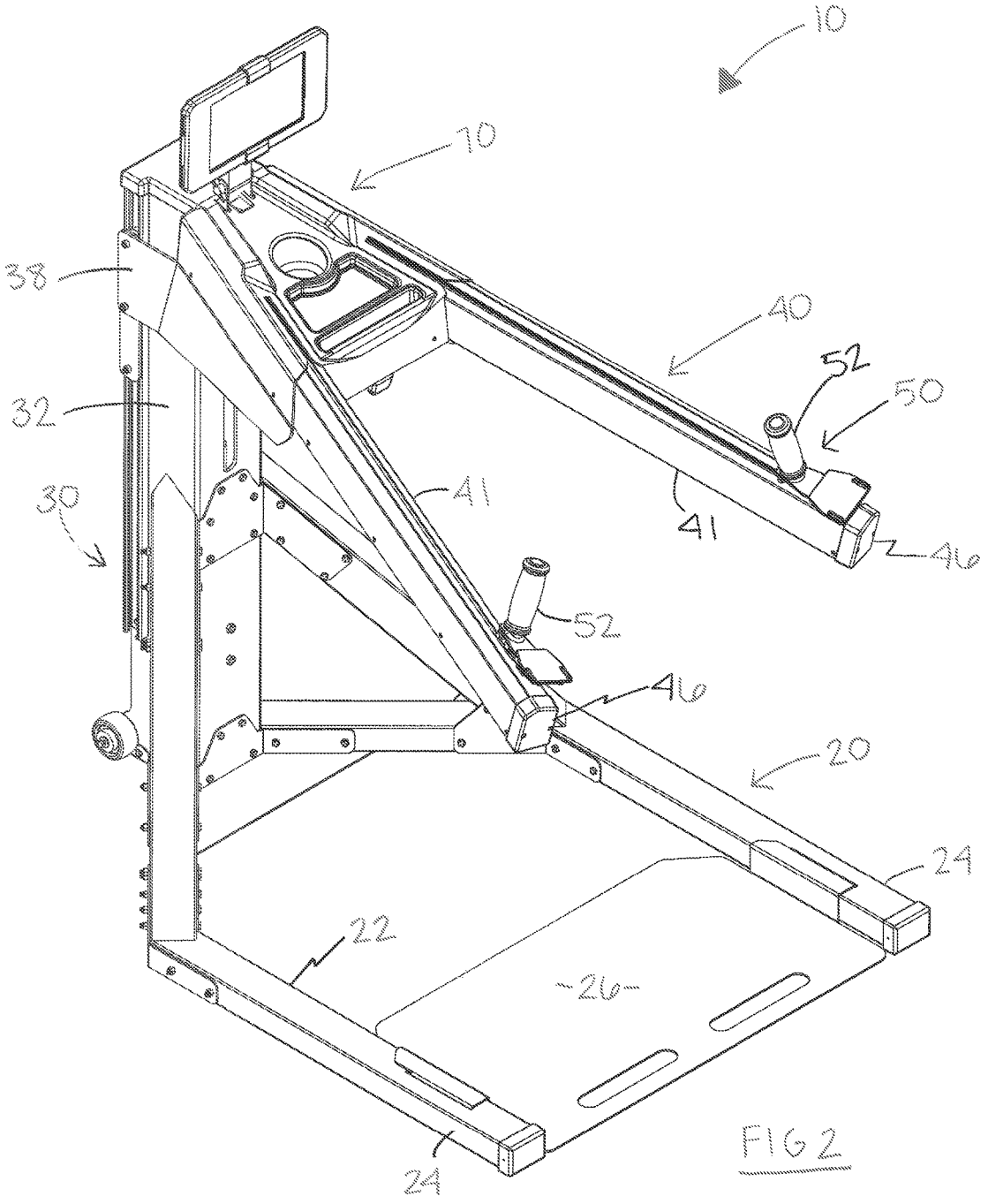
FIG. 2 is a perspective view of the illustrative embodiment of the exercise assembly of FIG. 1 having the carriage assembly disposed in an extended orientation.

A base assembly 20 in accordance with at least one embodiment of an exercise assembly 10 further comprises a base plate 26, such as is shown best in FIGS. 1 and 2. As will become evident from the present description, when a user is in an operative position for use of the present exercise assembly 10, the user's weight will be disposed substantially on the base plate 26, thereby further stabilizing the exercise assembly 10 on a supporting surface during use by the user.

Figure 3:
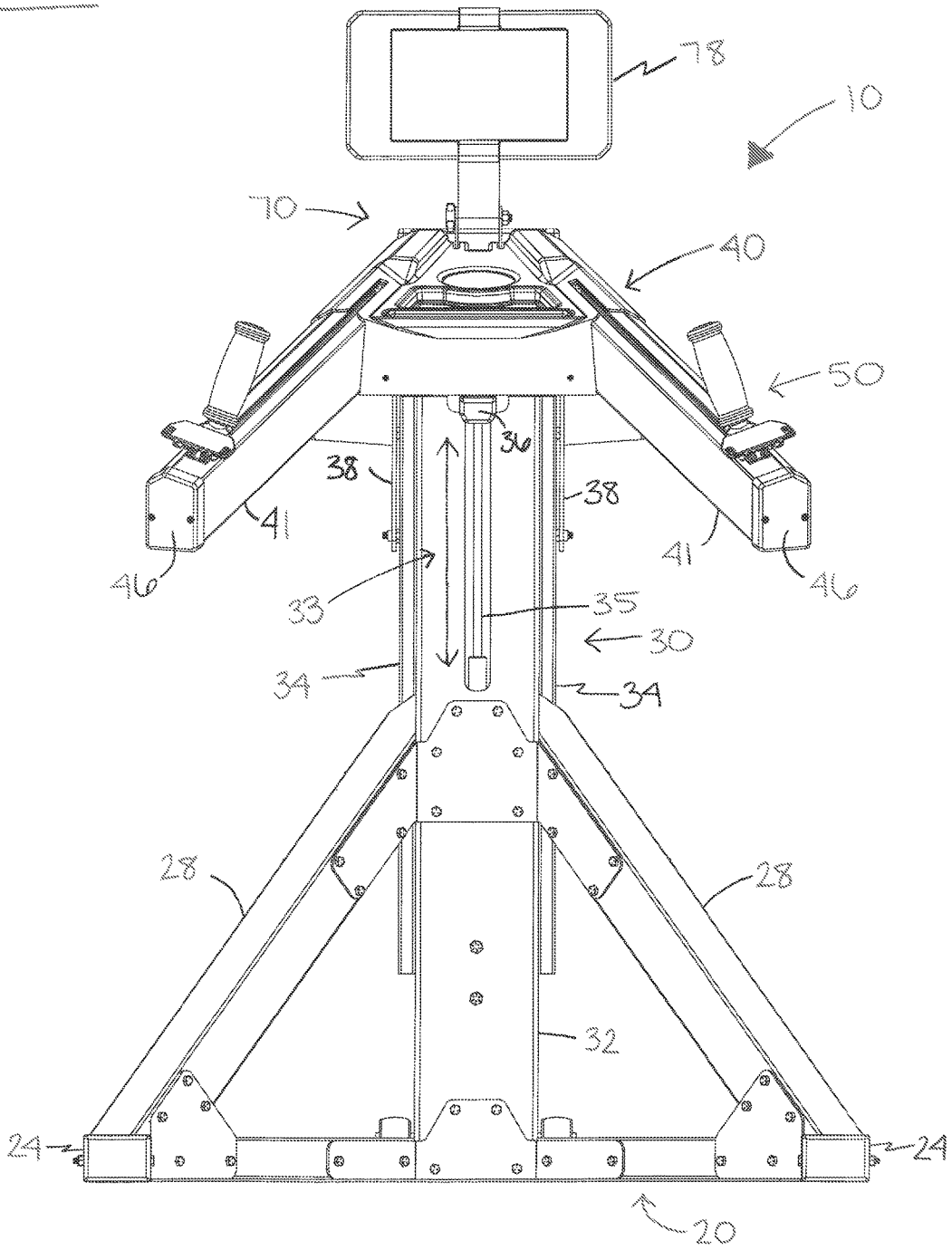
FIG. 3 is a front elevation of one illustrative embodiment of an exercise assembly in accordance with the present invention.
Figure 4:
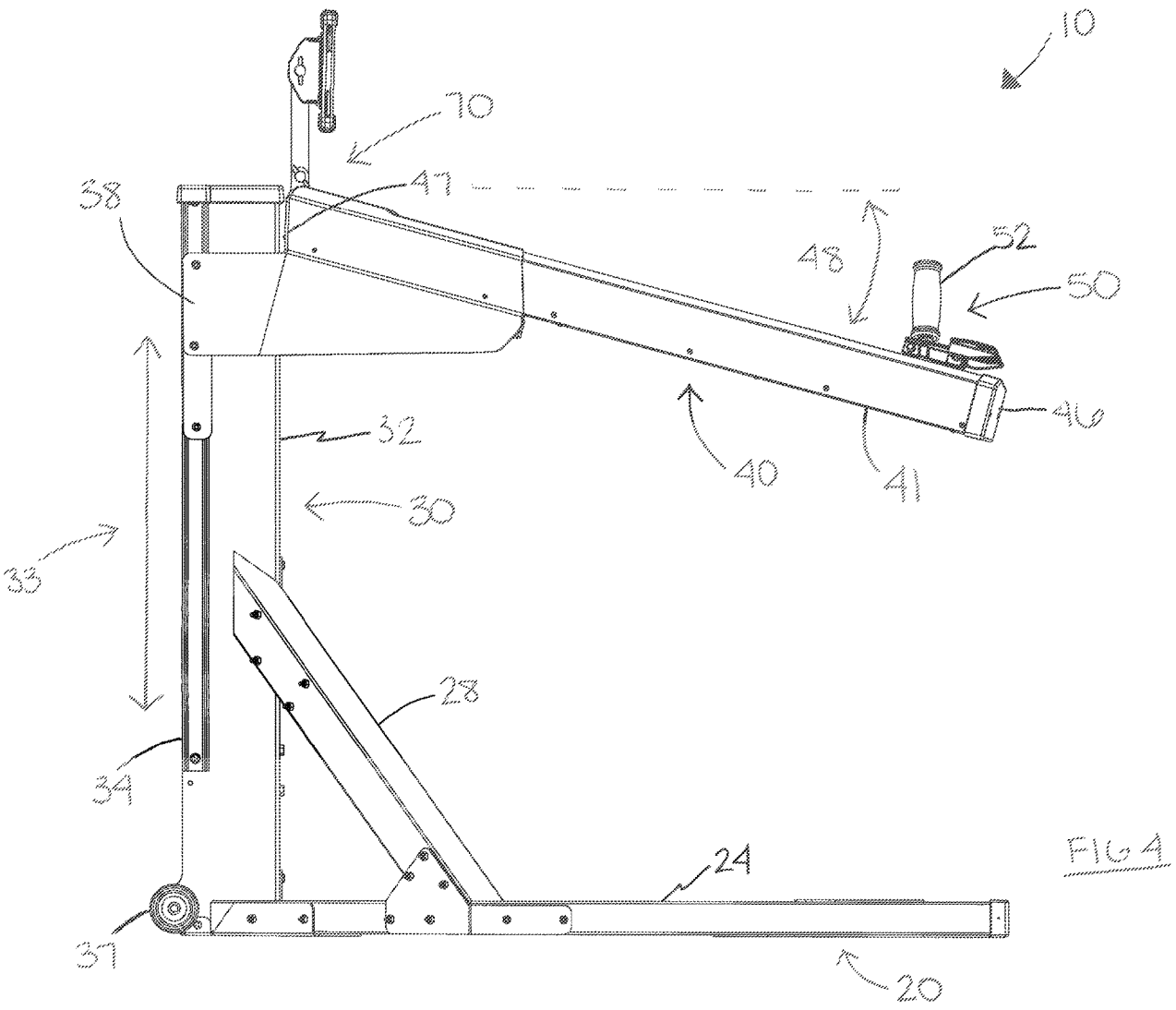
FIG. 4 is a right side elevation of one illustrative embodiment of an exercise assembly in accordance with the present invention having a resistive track assembly disposed in an elevated position along a support member.
Figure 5:
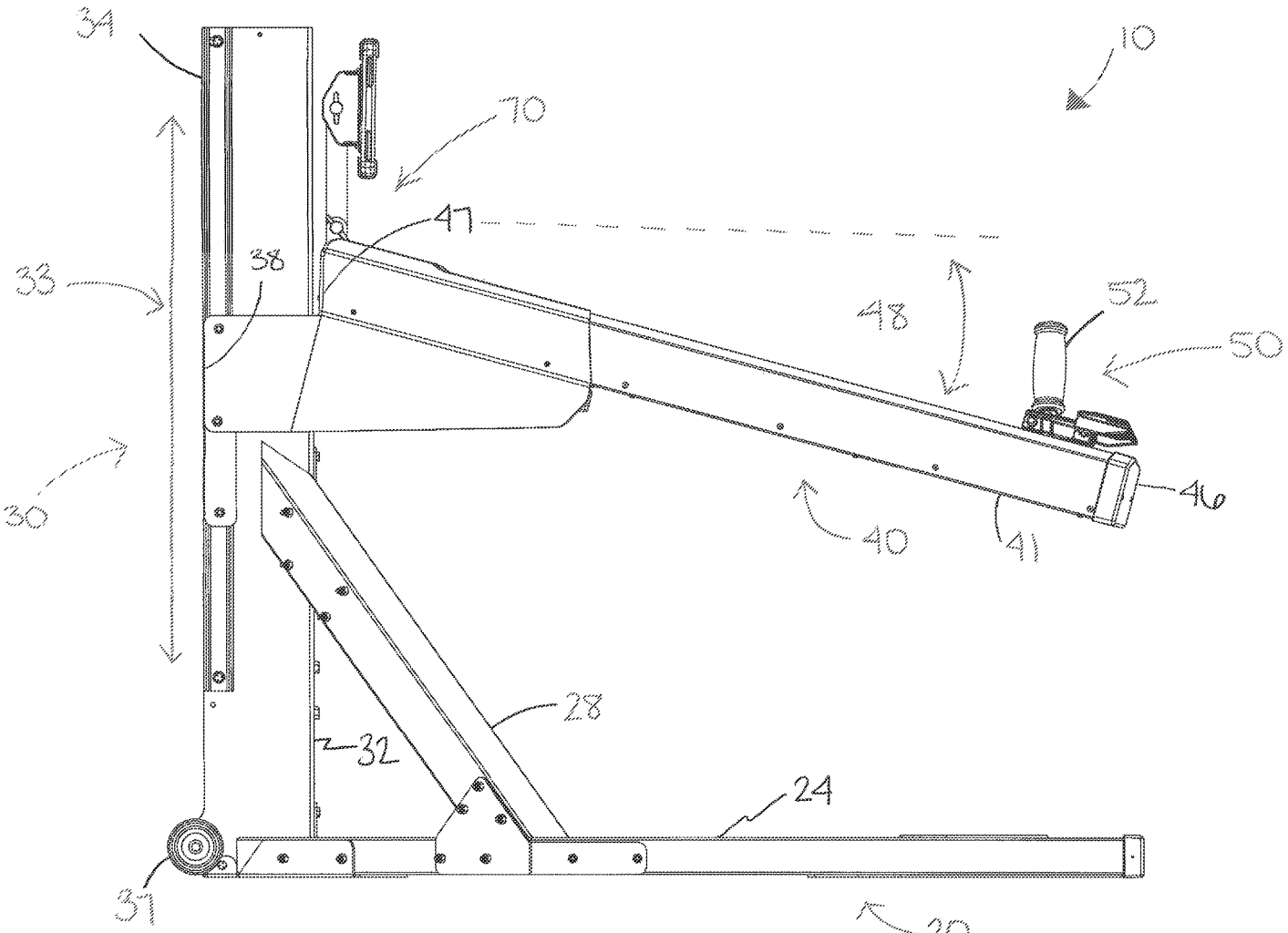
FIG. 5 is a right side elevation of the illustrative embodiment of the exercise assembly of FIG. 4 having the resistive track assembly disposed in a lowered position along the support member.
Figure 9:
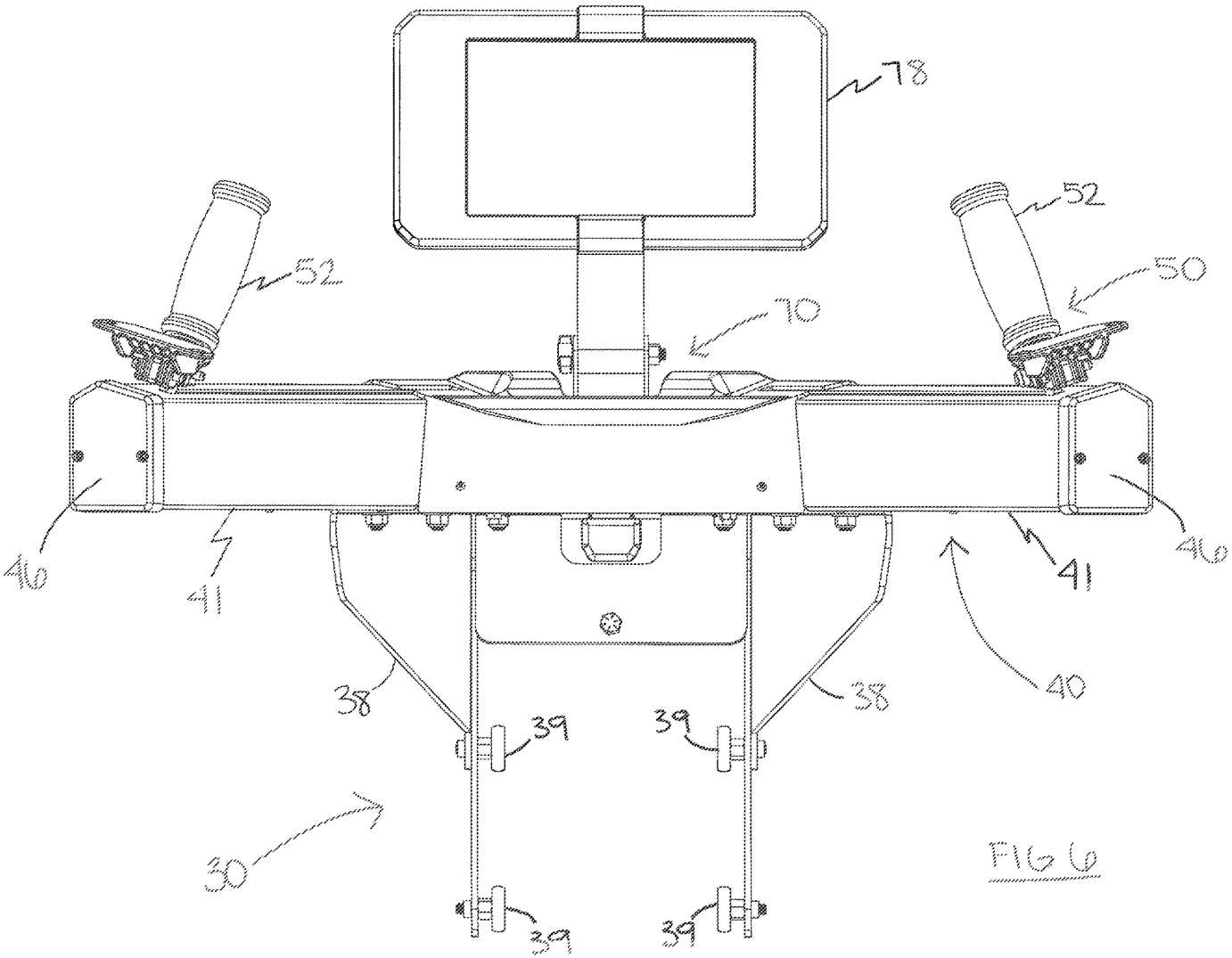
FIGS. 9A through 9D are diagrammatic representations of one illustrative embodiment of an interactive display in accordance with the present invention during various stages of execution of an exercise regimen by a user.

An exercise assembly 10 in accordance with the present invention also comprises a support assembly 30 having at least one support member 32, as shown best in FIGS. 1 through 5. As may be seen from the figures, a support assembly 30, and more in particular, a support member 32 is interconnected to at least a portion of a base 22. A base assembly 20 in at least one embodiment, such as is shown in FIGS. 3 through 5, further comprises at least one support member interconnect 28 which interconnects a support member 32 to at least one base member 24. As will be appreciated from the figures, and in particular, the illustrative embodiment of FIG. 3, a plurality of support member interconnects 28 will serve to further stabilize the exercise assembly 10 on a supporting surface during use by a user.

An exercise assembly 10 in accordance with the present invention further comprises a resistive track assembly generally as shown as 40 throughout the figures. As may be seen from the figures, a resistive track assembly 40 is mounted to a portion of support assembly 30 of the present invention. A resistive track assembly 40 in accordance with at least one embodiment of the present invention comprises at least one resistive track member 41. As will be appreciated from the present disclosure, a resistive track member 41 comprises the operative mechanisms of the present exercise assembly 10 which allow a user to implement linearly directed push/pull motions of his or her arms, shoulders, etc.

As may be seen from the illustrative embodiments of FIGS. 1 through 3, in at least one embodiment of the present exercise assembly 10, a resistive track assembly 40 comprises a plurality of resistive track members 41. Each resistive track member 41 comprises a proximal end 46 and a distal end 47. As may be seen from the figures, the proximal ends 46 of the plurality of the resistive track members 41 are sufficiently spaced apart to form an open proximal portion which allows room for a user to position himself or herself in an operative position therebetween. Once again, and as noted above, while a user is disposed in an operative position relative to a plurality of resistive track members 41 of the present exercise assembly 10, his or her weight will bear substantially upon base plate 26 adding stability to the exercise assembly 10 during use.

Figure 7:
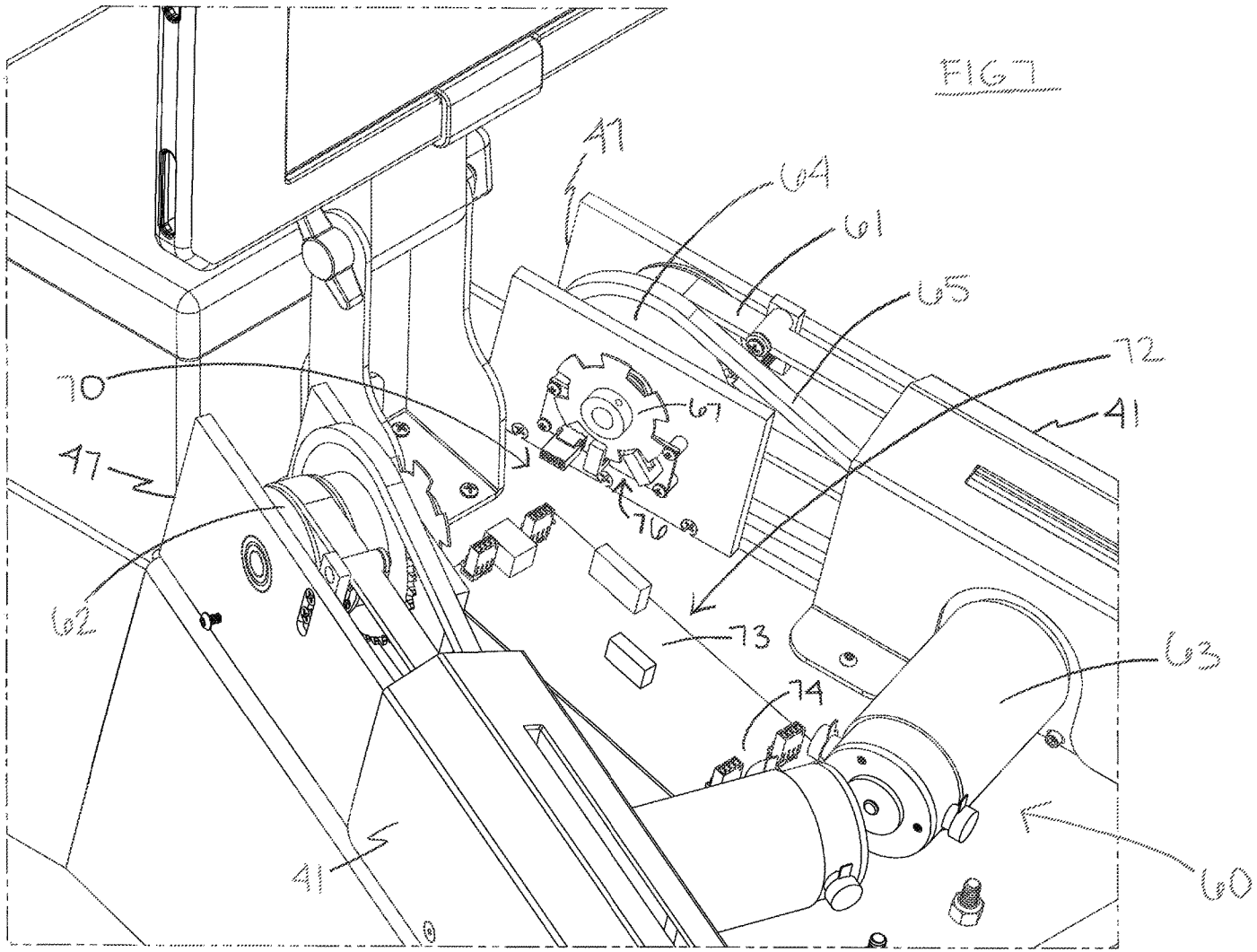
FIG. 7 is a perspective view of a portion of one illustrative embodiment of an exercise assembly in accordance with the present invention.

As will be appreciated best from the illustrative embodiment of FIG. 7, the distal ends 47 of the plurality of resistive track members 41 converge towards a closed distal portion of the exercise assembly 10. Throughout the illustrative embodiments of the figures, the plurality of resistive track members 41 are disposed in a V-shaped configuration. However, it will be appreciated and understood by those of skill in the art that one or more resistive track members 41 in accordance with the present invention may be configured and disposed in a variety of geometric configurations. As one example, a plurality of resistive track members 41 may be disposed spaced apart and substantially parallel to one another thereby forming a U-shaped configuration open at the proximal ends 46 and closed at distal ends 47.

An exercise assembly 10 in accordance with one embodiment of the present invention further comprises a carriage assembly generally shown as 50 throughout the figures. The carriage assembly 50 comprises at least one handle 52 which is interconnected to at least one carriage 54. Further, at least a portion of a carriage assembly 50 in accordance with the present invention is movable along at least a portion of a resistive track member 41. With reference to FIG. 1, the handles 52 of carriage assembly 50 are each disposed towards distal ends 47 of the corresponding resistive track members 41. Conversely, as shown in the illustrative embodiment of FIG. 2, the handles 52 of carriage assembly 50, are disposed towards proximal ends 46 of corresponding resistive track members 41.

As will be appreciated from the present disclosure, each resistive track member 41 is fully operable independent of any other resistive track member 41. As such, it is possible for the handle 52 of one carriage assembly 50 to be pushed toward a proximal end 46 of one corresponding resistive track member 41 while a handle 52 of another carriage assembly 50 is pulled towards a distal end 47 corresponding to another resistive track member 41, or vise versa.

A support assembly 30 in accordance with at least one embodiment of an exercise assembly 10 of the present invention further includes at least one support bracket 38 which is attached to a portion of a resistive track assembly 30. In at least one further embodiment, a support assembly 30 comprises a plurality of support brackets 38 which are attached to portions of a resistive track assembly 40, such as is shown best in illustrative embodiment of FIG. 6. FIG. 6 further illustrates support assembly 30 comprises a plurality of support guides 39 which are attached to support brackets 38. With reference to the illustrative embodiments of FIGS. 4 and 5, a support assembly 30 further comprises a guide track 34, wherein the guide track 34 is structured and dimensioned to receive each of the plurality of support guides 39 (not shown) which are attached to corresponding support bracket 38 of the support assembly 30. A support guide 39 in accordance with the present invention may comprise a wheel, roller, ball, or block of sufficiently low friction material to allow a corresponding resistive track assembly 40 to be freely positionable along a support member 32. In at least one embodiment, the guide track 34 and the plurality of support guides 39 affixed to support bracket 38 are cooperatively structured and dimensioned to facilitate positioning of track assembly 40 along a portion of support member 32 as shown by directional arrow 33. More in particular, the illustrative embodiment of FIG. 4 shows a resistive track assembly 40 disposed in an upward position along support member 32, while the illustrative embodiment of FIG. 5 shows a resistive track assembly 40 disposed in a lowered position along support member 32.

A resistive track angle 48 is formed between a horizontal axis emanating from a distal end 47 of a resistive track member 41, and an upper surface of the resistive track member 41. A resistive track angle 48 may be positive or negative relative to a horizontal axis, resulting in a user either pushing a handle 52 upwardly towards the proximal end 46 of the resistive track member 41 or downwardly towards the proximal end 46 of a resistive track member 41, respectively.

As shown in the illustrative embodiment of FIGS. 4 and 5, a resistive angle 48 is negative, such that a user will push downwardly on handle 52 of carriage assembly 50 towards the proximal end 46 of the resistive track member 41. In one embodiment of the present invention, a resistive track angle 48 is plus or minus about 30 degrees relative to a horizontal axis. In another embodiment, a resistive force angle 48 is about 0 to about minus 30 degrees relative to a horizontal axis. In one further embodiment, a resistive force angle 48 is about minus 10 to about minus 20 degrees relative to a horizontal axis, and in still one further embodiment, a resistive force angle 48 is about minus 15 degrees relative to a horizontal axis.

With reference to the illustrative embodiment of FIG. 3, in at least one embodiment of the present invention, a support assembly 30 further comprises a lift 35. In one embodiment, a lift 35 comprises an actuator 36 which causes the lift 35 either to raise and lower a resistive track assembly 40 along a support member 32 as shown by directional arrow 33. In at least one embodiment, a lift 35 comprises a pneumatic lift. It will be understood and appreciated by those of skill in the art that a lift 35 in accordance with the scope and intent of the present invention may comprise an electric lift, a hydraulic lift, a manual lift, etc., provided such lift facilitates movement and positioning a resistive track assembly 40 along a support member 32.

As such, an exercise assembly 10 in accordance with the present invention permits use by a user disposed in an operable orientation relative to a resistive track assembly 40 disposed in an upward position along a support member 32 while the user is standing upright on base plate 26. Alternatively, a resistive track assembly 40 may be lowered along a support member 32 in order to facilitate use of the present exercise assembly 10 by a user operably positioned relative to the resistive track assembly 40 while sitting in a chair or wheelchair substantially positioned on a base plate 26.

An exercise assembly 10 in accordance with the present invention further comprises a resistive force assembly, generally as shown as 60 throughout the figures. A resistive force assembly 60 in at least one embodiment comprises at least one resistive force member 61, wherein the at least one resistive force member 61 is interconnected to at least one carriage 54. A resistive force member 61 in accordance with the present invention presents a resistive force to counter movement of a carriage 54 along a portion of a corresponding resistive track member 41, whether the movement is from a proximal end 46 towards a distal end 47 of a resistive track member 41, or if the movement is from a distal end 47 towards a proximal end 46 of a resistive track member 41.

In one further embodiment, a resistive force assembly 60 comprises a plurality of resistive force members 61 each being interconnected to a different one of each of a plurality of carriages 54 of a carriage assembly 50. As before, each resistive force member 61 presents a resistive force to counter movement of a corresponding carriage 54 along a portion of a resistive track member 41, once again, regardless of the direction of movement along the resistive track member 41.

A restive force member 61 in accordance with at least one embodiment of the present invention comprises a composite Kevlar-polyurethane material of construction. In once further embodiment, a resistive force member 61 in accordance with the present invention comprises a toothed configuration, so as to minimize slippage between a resistive force member 61 and resistive force member guide pulleys 62, 62', as are discussed in further detail below. Of course, it will be appreciated by those of skill in the art that other materials of construction and/or other configurations of a resistive force member 61 may be utilized, and remain within the scope and intent of the present invention.

A resistive force assembly 60 of an exercise assembly 10 in accordance with the present invention comprises at least one resistive force drive 63. More in particular, at least one resistive force drive 63 operably engages one or more of a plurality of resistive force members 61 and exerts at least one resistive force thereto to counter movement of one or more carriages 54 along a portion of a resistive track member 41. In at least one further embodiment, at least one resistive force drive 63 is operable with each of a plurality of resistive force members 61 to exert any of a plurality of preselected resistive forces to counter movement of each of a plurality of corresponding carriages 54.

In at least one further embodiment, a resistive force assembly 60 in accordance with the present invention comprises a plurality of resistive force drives 63, wherein each of the resistive force drives 63 engages a different one of a plurality of resistive force members 61. In such an embodiment, each of the plurality of resistive force drives 63 exerts a resistive force to a corresponding resistive force member 61 to counter movement of carriage 54 interconnect thereto, along a portion of a corresponding one of resistive track members 41.

In one further embodiment, an exercise assembly 10 in accordance with the present invention comprises a resistive force assembly 60 wherein each of a plurality of resistive force drives 63 operably engages a different one of a plurality of resistive force members 61, and each resistive force drive 63 exerts an approximately equivalent preselected resistive force to a different one of each of the plurality of resistive force members 61 in one direction relative to a user, to counter movement of a corresponding carriage 54 along a portion of a corresponding one of a plurality of resistive track members 41.

In yet another embodiment, an exercise assembly 10 in accordance with the present invention comprises a resistive force assembly 60 wherein each of a plurality of resistive force drives 63 operably engages a different one of each of a plurality of resistive force members 61, and one or more of the plurality of resistive force drives 63 exert a different preselected resistive force to different ones of the plurality of resistive force members 61 in one direction relative to a user to counter movement of a corresponding carriage 54 along a portion of a corresponding one of a plurality of resistive track members 41.

An exercise assembly 10 in accordance with yet another embodiment of the present invention comprises a resistive force assembly 60 wherein each of a plurality of resistive force drives 63 operably engages a different one of a plurality of resistive force members 61, and at least two of the plurality of resistive force drives 63 exert an approximately equivalent preselected resistive force to different ones of the plurality of resistive force members 61 in opposite directions relative to a user to counter movement of a corresponding carriage 54 along a portion of a corresponding one of a plurality of resistive track members.

In still one further embodiment, an exercise assembly 10 in accordance with the present invention comprises a resistive force assembly 60 wherein each of a plurality of resistive force drives 63 operably engages a different one of each of a plurality of resistive force members 61, and at least two of the plurality of resistive force drives 63 exert a different preselected resistive force to different ones of the plurality of resistive force members 61 in opposite directions relative to a user to counter movement of a corresponding carriage 54 along a portion of a corresponding one of a plurality of resistive track members 41.

An exercise assembly 10 in accordance with at least one embodiment of the present invention comprises a resistive force assembly 60 having a resistive force drive 63 which comprises a direct current motor. Incorporation of a direct current motor as a resistive force drive 63 allows for substantially instantaneous application of a resistive force to a corresponding resistive force member 61 in accordance with a preselected resistive force such as may be set by a control module 70, as discussed in greater detail below. Further, use of a direct current motor as a resistive force drive 63 also allows for essentially instantaneous reversal in a direction of a preselected resistive force exerted on a resistive force member 61, such as when a user changes a direction of movement of a carriage 54 along a resistive track member 41.

Figure 8:
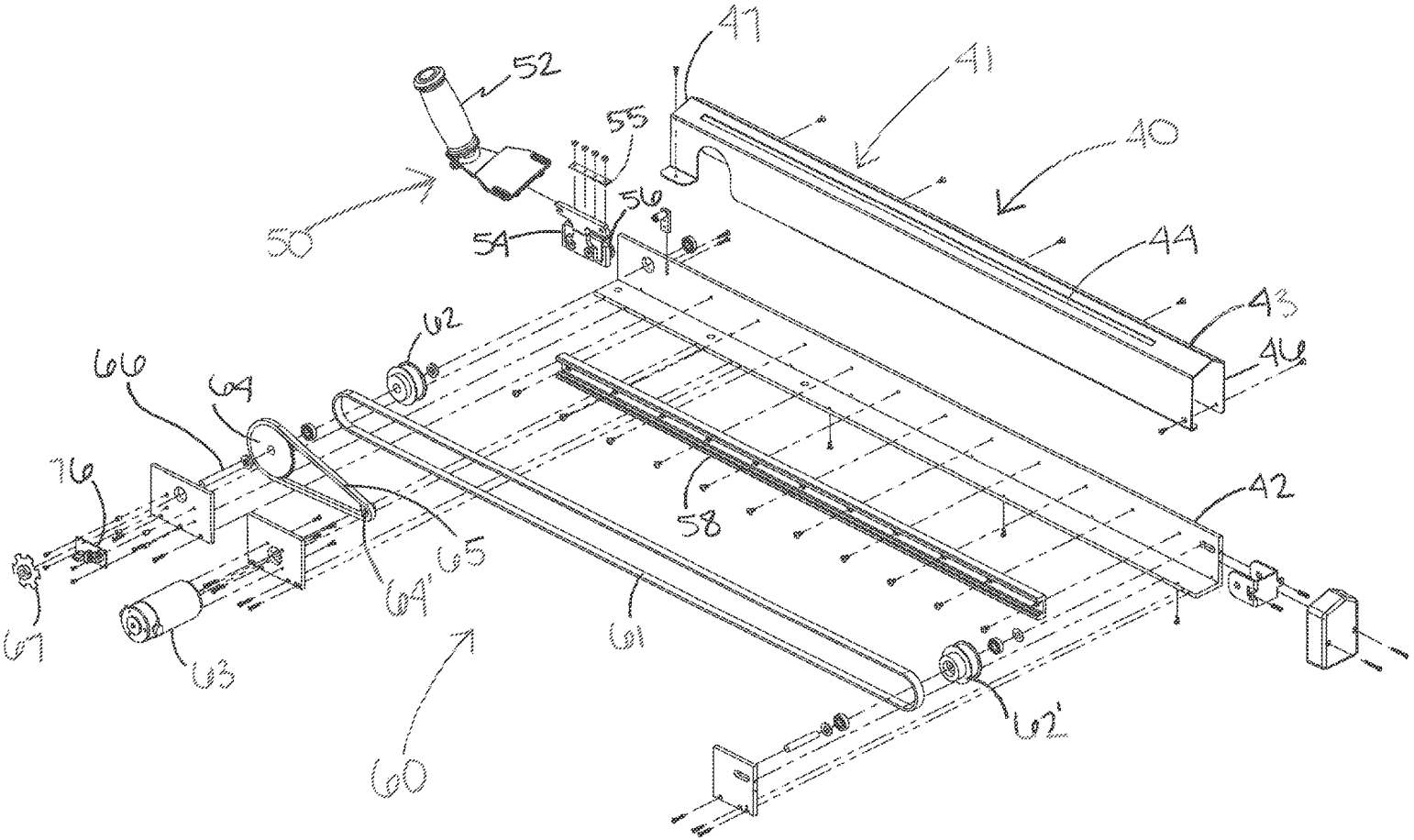
FIG. 8 is an exploded perspective view of one illustrative embodiment of a resistive track assembly, a carriage assembly, and a resistive force assembly of an exercise assembly in accordance with the present invention.

Turning next to FIG. 8, an exploded perspective view of one illustrative embodiment of a resistive track assembly 40, carriage assembly 50, and resistive force assembly 60 in accordance with the present invention is presented. To begin, a resistive track assembly 40 comprises at least one resistive track member 41. In at least one embodiment, a resistive track member 41 comprises a resistive track member base 42. A resistive track member base 42 in accordance with the present invention is constructed of aluminum alloy, however, it will be appreciated by those of skill in the art that other materials of construction, including but not limited to other metals, metal alloys, engineered plastics, etc., may be utilized in accordance with the present invention. With further reference to the illustrative embodiment of FIG. 8, a resistive track member 41 further comprises a resistive track member housing 43 having a resistive track channel 44 disposed through a portion thereof. As may be seen from FIG. 8, in at least one embodiment, a resistive track channel 44 comprises an elongated configuration extending along a length of a resistive track member housing 43 between a proximal end 46 and distal end 47 of resistive track member 41. In at least one embodiment, a resistive track channel 44 comprises an elongated slot like configuration. FIG. 8 further illustrates that in at least one embodiment, a resistive track member housing 43 comprises a pitched upper portion having two angled sides, with a resistive track channel 43 disposed along and through one of the angled sides thereof.

FIG. 8 further presents one illustrative embodiment of a carriage assembly 50 in accordance with the present invention. As shown in the illustrative embodiment of FIG. 8, a carriage assembly 50 comprises a handle 52. In at least one embodiment, a handle 52 is cushioned for the comfort of a user while executing an exercise regimen on exercise assembly 10 of the present invention. In one further embodiment, a handle 52 of a carriage assembly 50 is angled inwardly towards a user, once again, for the comfort of the user while executing an exercise regimen on the present exercise assembly 10. As noted above, a resistive track member housing 43 comprises a pitched top portion with a resistive track channel 44 disposed along and through an inwardly facing side of the pitched upper section, thereby providing for the angled orientation of a handle 52 of carriage assembly 50. In at least one embodiment, a handle 52 is offset about 15 to about 20 degrees from a vertical axis extending through the center of a base thereof.

A carriage 54 is interconnected to a handle 52 through a resistive track channel 44 disposed on a resistive track member housing 43. In at least one embodiment, a carriage 54 includes an interconnect 55 which is utilized to affix a portion of a resistive force member 61 to carriage 54. As shown in the illustrative embodiment of FIG. 8, carriage assembly 50 further comprises a carriage track 58 which is secured to a portion of a resistive track member base 42. Carriage 54 further comprises at least one carriage glide 56 which operatively engages a carriage track 58 to facilitate movement of the carriage 54 along a portion of a resistive track member 41. In at least one embodiment a carriage track 58 in accordance with the present invention comprises a hardened steel construction, while a carriage glide 56 comprises one or more steel wheels. As before, it will be appreciated by those of skill in the art that any of a plurality of other materials of construction may be utilized for carriage track 58 and/or carriage glide(s) 56 in accordance with the present invention, once again, including but not limited to other metals, metal alloys, engineered plastics, etc.

FIG. 8 also presents one illustrative embodiment of a resistive force assembly 60 in accordance with the exercise assembly 10 of the present invention. As may be seen from FIG. 8, a resistive force assembly 60 comprises a resistive force member 61 and a corresponding plurality of resistive force member guide pulleys 62, 62' disposed at opposite ends thereof. As further shown in FIG. 8, resistive force member guide pulleys 62, 62' are mounted on opposite ends of a resistive track member base 42 via an appropriate arrangement of washers, sleeves, and/or bearings, to allow free movement thereof. As previously noted, a portion of the resistive force member 61 is affixed to a carriage 54 and thus, in combination with resistive force member guide pulleys 62, 62', carriage assembly 50, and more in particular, carriage 54 interconnected to handle 52, a user can move a portion of a resistive force member 61 between a proximal end 46 and a distal end 47 of a resistive track member 41.

FIG. 8 further illustrates a drive member 65 which is interconnected to resistive force member guide pulley 62 via drive gears 64, 64', which themselves are operatively engaged via the drive member 65. In at least one embodiment, a drive member 65 comprises a drive chain. In one embodiment, and as shown in FIG. 8, a resistive force assembly 60 further comprises an optical indicator 67 disposed at one end thereof. A spline 66 interconnects resistive force member guide pulley 62, drive gear 64, and optical indicator 67 together such that each of these components rotate together with one another as a user moves a corresponding resistive force member 61 along a portion of resistive track member 41.

In operation a resistive force drive 63 applies a resistive force to drive gear 64' which thereby transfers the resistive force to drive gear 64, via drive member 65, which then in turn, by virtue of interconnection via spline 66, exerts a resistive force to resistive force member guide pulley 62. As a result, a resistive force applied by resistive force drive 63 to drive gear 64' is translated to a resistive force exerted on resistive force member 61 via restive force member guide pulley 62. As previously noted, a resistive force to be exerted on a resistive force member 61 may be preselected by a control module 70, once again, as discussed in more detail below.

Thus, when a user pushes or pulls on a handle 52, a corresponding carriage 54 will move back and forth along a portion of a resistive track member 41 only if a user overcomes a preselected resistive force exerted on a resistive force member 61, a portion of which is affixed to carriage 54. It will be further appreciated with reference to FIG. 8, that as a user moves resistive force member 61 along a portion of a resistive track member 41, resistive force member guide pulley 62 will rotate thereby causing an optical indicator 67 to rotate equally, once again, as a result of interconnection via spline 66. As shown in the illustrative embodiments of FIGS. 7 and 8, an optical reader 76 is provided in at least one embodiment of the present invention in order to measure the rotational movement of an optical indicator 67. Based on a measured rotational movement of an optical indicator during an exercise regimen, a total distance traveled by a resistive track member 61 along a portion of a resistive track member 41 during an exercise regimen executed by a user may be calculated. The total distance traveled by a resistive force member 61, along with the preselected resistive force exerted on the resistive force member 61 to be overcome by a user, allows for calculation of an amount of work performed by a user during execution of an exercise regimen.

With reference next to the illustrative embodiment of FIG. 7, and as previously noted above, in at least one embodiment of the present invention the exercise assembly 10 comprises a control module which is general shown as 70. As may be seen from the illustrative embodiment of FIG. 7, the control module 70 comprises a controller 72. A circuit board 73 includes the operative components of controller 72. For example, circuit board 73 comprises resistive force controller 74 utilized to instruct one or more resistive force drives 63 to exert at least one preselected resistive force to a corresponding resistive force member 61. In at least one embodiment, a resistive force controller 74 is utilized to direct a plurality of resistive force drives 63 to exert each of a plurality of preselected resistive forces to one or more of a plurality of resistive force members 61 as selected by a user of the exercise assembly 10 in accordance of the present invention. As noted above, a control module 70 further comprises an optical reader 76 which is disposed in optical communication with an optical indicator 67 of a resistive force assembly 60 in order to measure an amount of rotational movement thereof, to allow for calculation of a corresponding resistive force member 61 along a portion of a resistive track member 41.

Figure 9A:
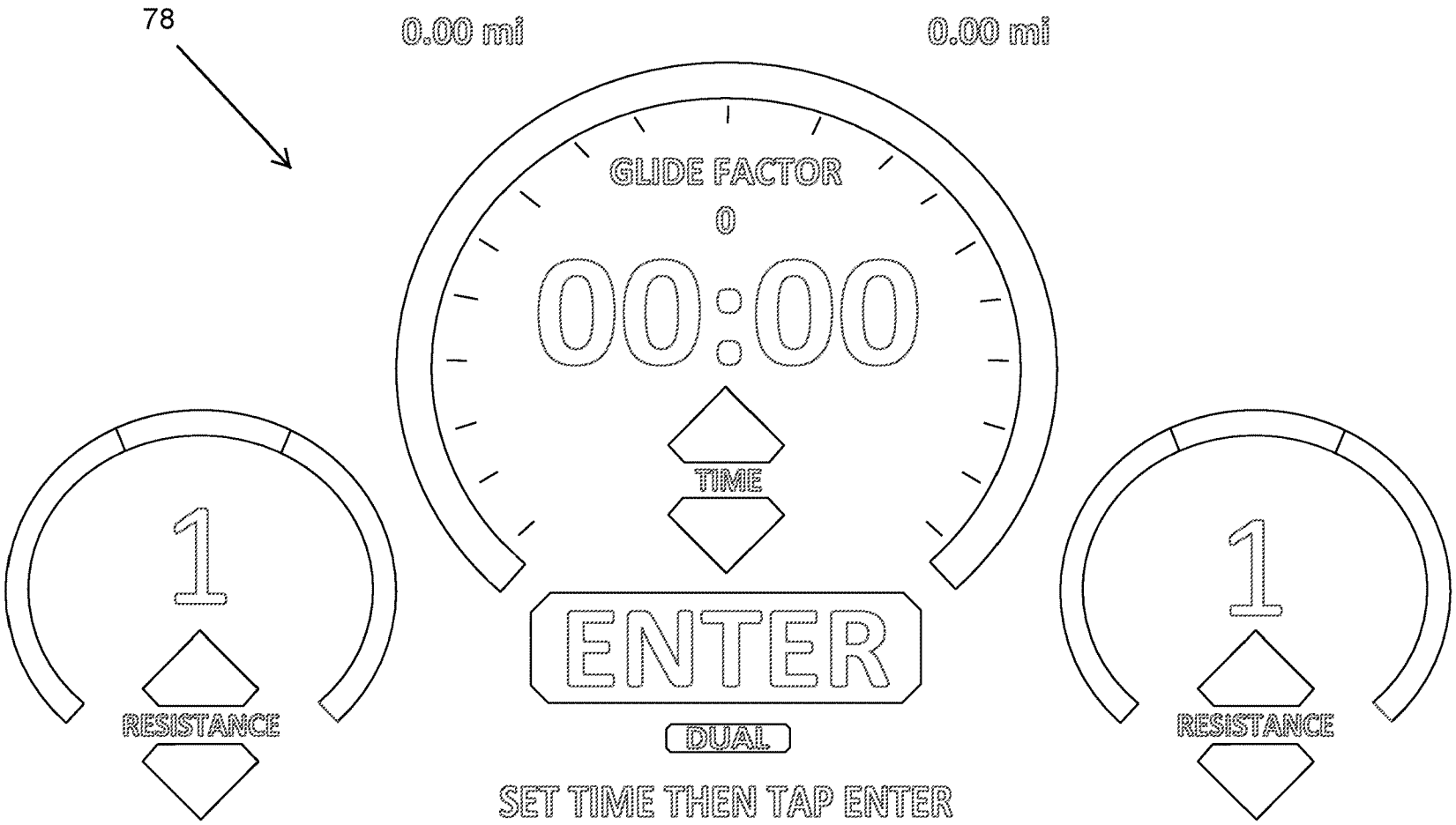
Figure 9B:
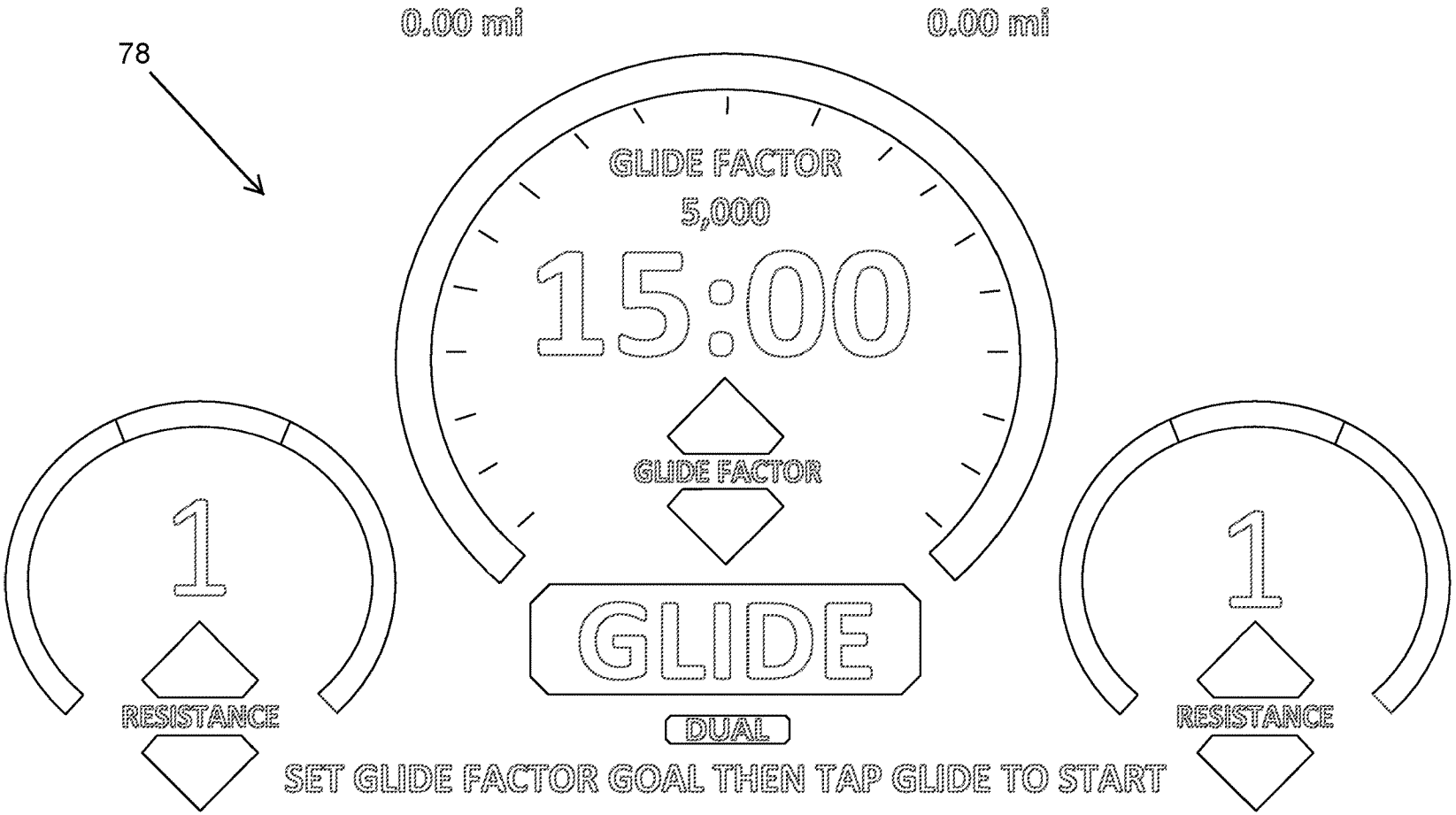
Figure 9C:
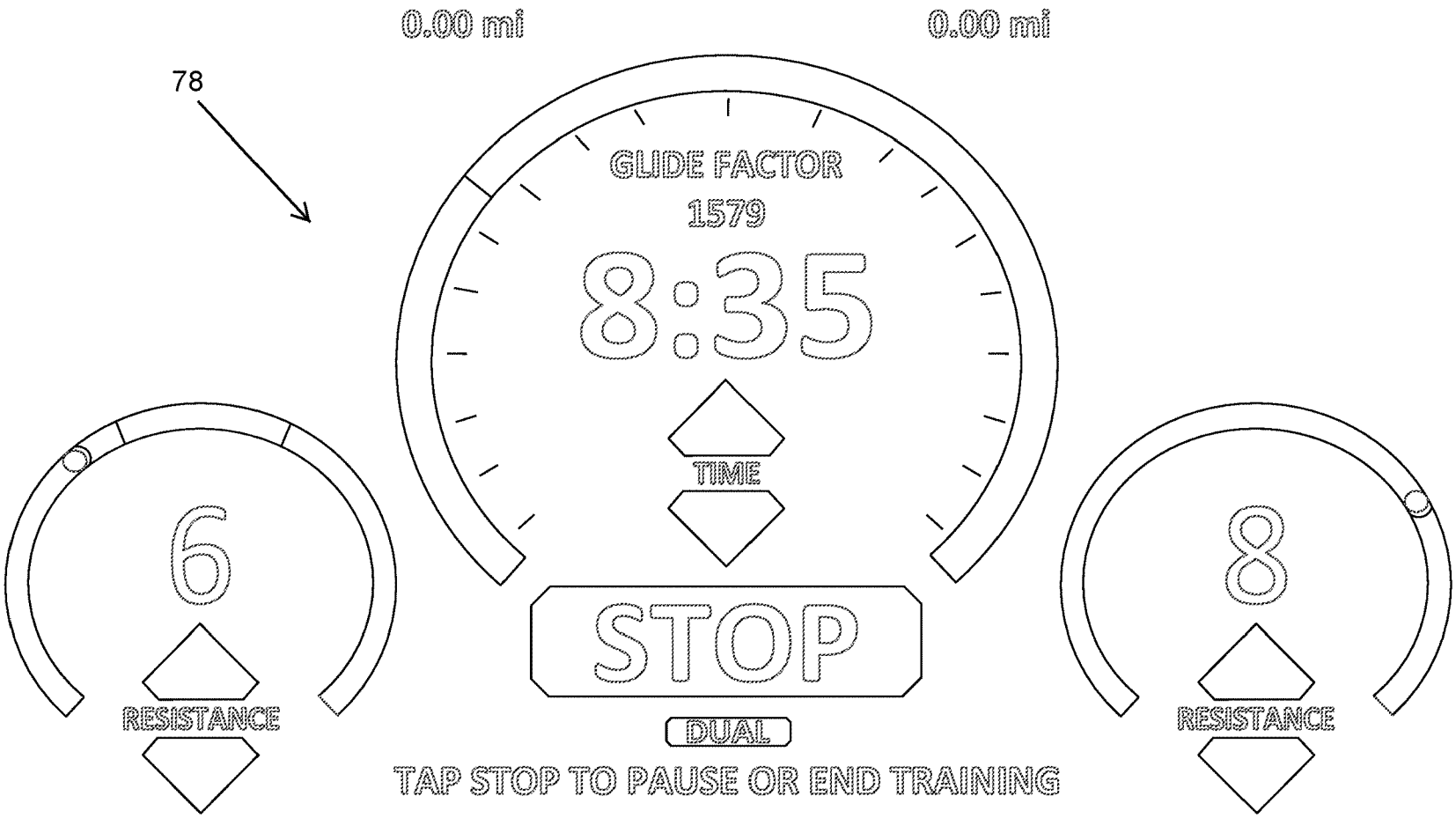
Figure 9D:
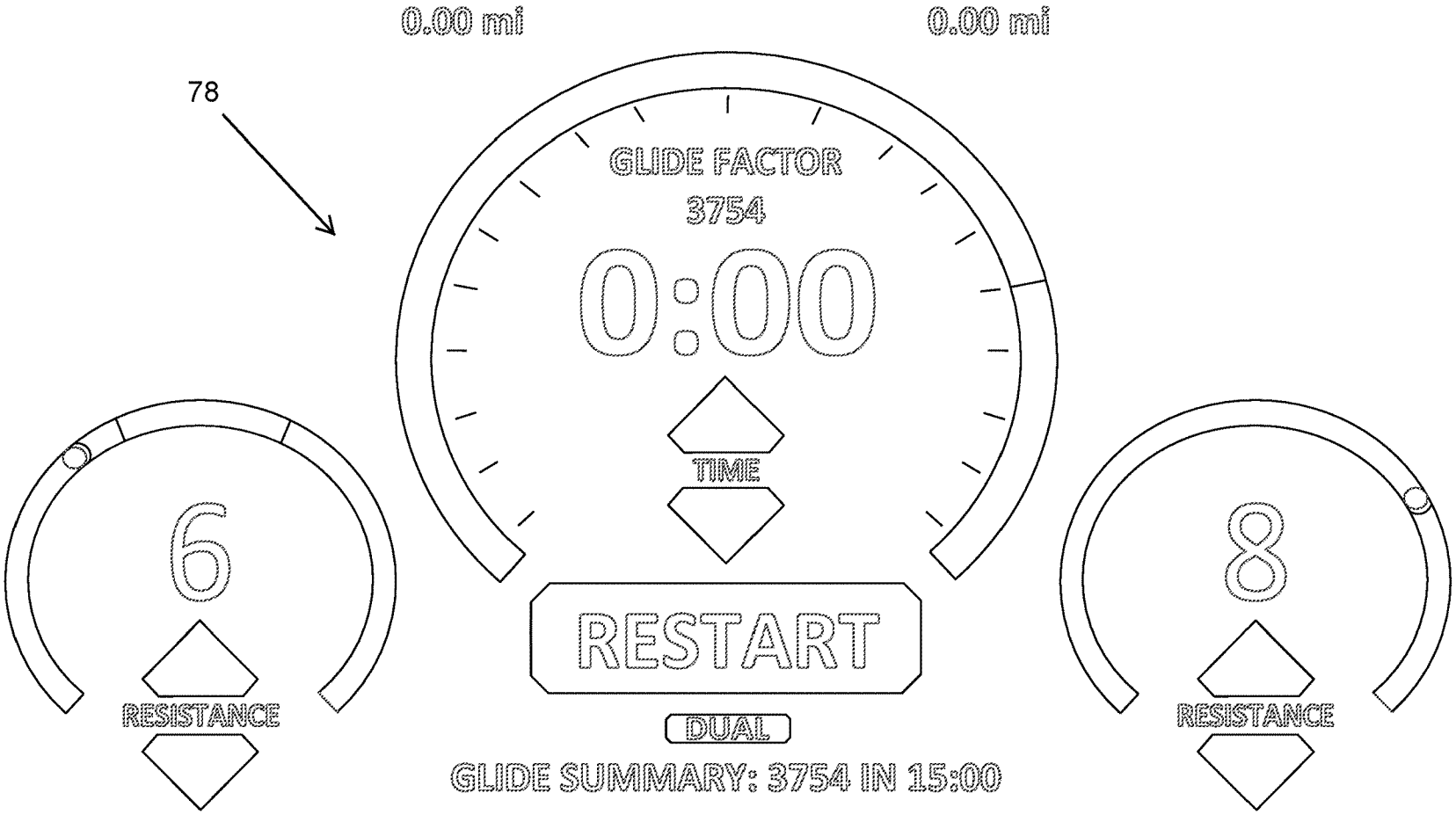

FIGS. 9A through 9D are illustrative of an interactive display 78 of a control module 70 (not shown) in accordance with the exercise assembly 10 of the present invention during one cycle of an exercise regimen executed by a user. In particular, FIG. 9A shows an interactive display 78 prior to a user initiating a regimen, wherein a Glide Factor is set to "0", a time display shows "00:00", and a preselected resistance of "1" is set for each of a corresponding right and left restrictive force members 61 (not shown). FIG. 9B illustrates a user selected Glide Factor goal of "5000" and a "15:00" minute duration of an exercise regimen. FIG. 9C shows that with a time remaining of "8:35" minutes, and a preselected resistive force of "6" for a left resistive force member 61 (not shown) and a preselected resistive force of "8" for a right resistive force member 61 (not shown), the user has attained a glide factor of "1579". Finally, FIG. 9D illustrates that upon completion of the 15 minute exercise regimen, the user attained a Glide Factor of "3754" in the allotted 15 minute exercise regimen, which is over 75% of the user's initial goal. As used herein, a "Glide Factor" is a value that is calculated by summing a measured current times a measured voltage for each of a plurality of resistive force drives 63, and multiplying the sum by a scale factor. In essence, as used herein, a Glide Factor is a unit of power, similar to a measurement in Watts. As such, a control module 70 in accordance with the present invention, and in particular, the interactive display 78 of control module 70 allows a user to designate one or more preselected resistive forces for each of a plurality of resistive force drives 63 which are subsequently exerted to corresponding ones of a plurality of resistive force members 61. Interactive display 78 further allows a user to set a goal for each exercise regimen such as, by way of example only, a Glide Factor. Lastly interactive display 78 provides a user with a summary of a user's actual performance, once again, by way of example only, as measured by a Glide Factor, during an exercise regimen.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. An exercise assembly for execution of an exercise regimen by a user, said exercise assembly comprising:

a base assembly having base comprising at least one base member, a support assembly having a support member interconnected to said base, a resistive track assembly comprising a plurality of resistive track members, wherein said resistive track assembly is positionably mounted to said support member, each said resistive track member comprising a resistive track channel disposed through a portion thereof, a carriage assembly comprising at least one handle interconnected to at least one carriage through said resistive track channel of a different one of each of said plurality of resistive track members, wherein each said handle and interconnected one of said carriage are moveable along a portion of a corresponding one of said plurality of resistive track members, a resistive force assembly comprising a plurality of resistive force members, at least one of said plurality of resistive force members interconnected to a different one of each said carriage and presents a preselected resistive force to counter movement of said carriage along said portion of said corresponding one of said plurality of resistive track members, said resistive force assembly further comprising a plurality of resistive force drives, wherein each of said plurality of resistive force drives operably engages a different one of each of said plurality of resistive force members and exerts said preselected resistive force thereto to counter movement of said carriage along said portion of said corresponding one of said plurality of resistive track members, and a control module operable with said resistive force assembly to control said preselected resistive force exerted by each of said plurality of resistive force drives.

2. The exercise assembly as recited in claim 1 wherein each of said plurality of resistive force drives operably engages a different one of each of said plurality of resistive force members and exerts an approximately equivalent preselected resistive force thereto in one direction relative to the user to counter movement of said carriage along said portion of said corresponding one of said plurality of resistive track members.

3. The exercise assembly as recited in claim 1 wherein each of said plurality of resistive force drives operably engages a different one of each of said plurality of resistive force members and one or more of said plurality of resistive force drives exerts a different preselected resistive force thereto in one direction relative to the user to counter movement of said carriage along said portion of said corresponding one of said plurality of resistive track members.

4. The exercise assembly as recited in claim 1 wherein each of said plurality of resistive force drives operably engages a different one of each of said plurality of resistive force members and at least two of said plurality of resistive force drives exert an approximately equivalent preselected resistive force thereto in opposite directions relative to the user to counter movement of said carriage along said portion of said corresponding one of said plurality of resistive track members.

5. The exercise assembly as recited in claim 1 wherein each of said plurality of resistive force drives operably engages a different one of each of said plurality of resistive force members and at least two of said plurality of resistive force drives exert a different preselected resistive force thereto in opposite directions relative to the user to counter movement of said carriage long said portion of said corresponding one of said plurality of resistive track members.

6. The exercise assembly as recited in claim 1 wherein said support assembly further comprises a pneumatic lift operably engaging said resistive track assembly and movably positioning said resistive track assembly along said support member.

7. The exercise assembly as recited in claim 1 wherein said control module comprises at least one optical reader disposed in optical communication with at least one optical indicator to measure an amount of movement of at least one of said plurality of resistive force members.

8. The exercise assembly as recited in claim 1 wherein said control module comprises a plurality of optical readers each disposed in optical communication with at least one of a plurality of optical indicators to measure an amount of movement of each of said plurality of resistive force members.

9. The exercise assembly as recited in claim 7 wherein said control module calculates an amount of work performed by the user based on said amount of movement of said at least one of said plurality of resistive members and a corresponding preselected resistive force.

10. The exercise assembly as recited in claim 8 wherein said control module calculates an amount of work performed by the user based on said amount of movement of each of said plurality of resistive members and a corresponding one of said preselected restrictive forces.

* * * * *